United States Patent [19]

Wahle et al.

[11] Patent Number: 4,776,351

[45] Date of Patent: Oct. 11, 1988

[54] METHOD OF AND APPARATUS FOR APPLYING ADHESIVE TO A RUNNING WEB OF WRAPPING MATERIAL OF THE TOBACCO PROCESSING INDUSTRY

[75] Inventors: Günter Wahle, Reinbek; Dieter Ludszeweit, Hamburg, both of Fed. Rep. of Germany

[73] Assignee: Körber AG, Hamburg, Fed. Rep. of Germany

[21] Appl. No.: 911,231

[22] Filed: Sep. 24, 1986

[30] Foreign Application Priority Data

Sep. 27, 1985 [DE] Fed. Rep. of Germany ..... 3534454

[51] Int. Cl.[4] ..... A24C 5/24

[52] U.S. Cl. ..... 131/69; 131/90; 131/92

[58] Field of Search ..... 131/90, 94, 95, 84.1, 131/61.1, 67–69, 29, 32, 35, 37, 910, 904; 156/201, 272.3

[56] References Cited

U.S. PATENT DOCUMENTS

| | | | |
|---|---|---|---|
| 3,412,856 | 11/1968 | Esenwein | 209/74 |
| 4,177,670 | 12/1976 | Heitmann et al. | 73/38 |
| 4,249,547 | 2/1981 | Hinzmann | 131/94 |
| 4,282,889 | 8/1981 | Dahlgrün | 131/94 |
| 4,574,817 | 3/1986 | Suzuki et al. | 131/94 |

*Primary Examiner*—V. Millin

*Attorney, Agent, or Firm*—Peter K. Kontler

[57] ABSTRACT

One side of a running web of wrapping material of the tobacco processing industry is provided with adhesive by a nozzle which discharges a stream of minute droplets of liquid adhesive. The droplets are charged by a first electrode immediately after they issue from the orifice of the nozzle and the droplets of the stream are thereupon deflected relative to the running web by a pair of deflecting electrodes whose operation is controlled by an adjustable circuit so as to ensure that the application of adhesive can take place in accordance with variations of one or more parameters including the speed of the running web and/or the permeability of wrappers which are obtained from the adhesive-coated web.

18 Claims, 3 Drawing Sheets

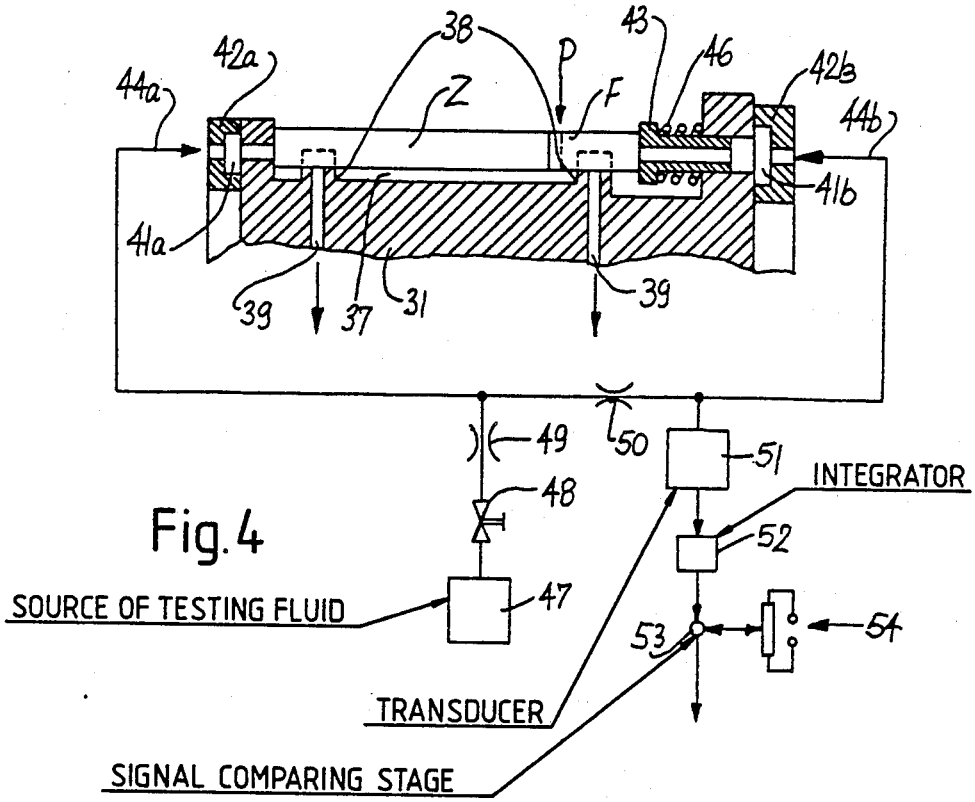
Fig.4
Fig.5
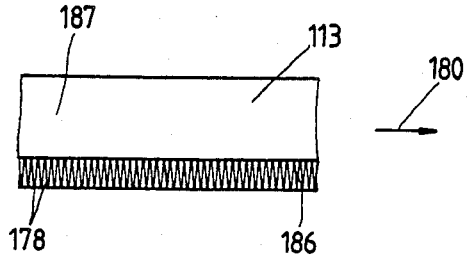

METHOD OF AND APPARATUS FOR APPLYING ADHESIVE TO A RUNNING WEB OF WRAPPING MATERIAL OF THE TOBACCO PROCESSING INDUSTRY

BACKGROUND OF THE INVENTION

The present invention relates to a method of and to an apparatus for applying liquid adhesives to running webs or strips of wrapping material which is used in the tobacco processing industry, particularly for the making of rods which contain fillers of smokable material and/or filter material for tobacco smoke.

At the present time, liquid adhesive is applied to one side of a running web of cigarette paper, filter paper, tipping paper or a similar wrapping material which is used in the tobacco processing industry by employing a driven applicator roller, an idler applicator roller or one or more nozzles which discharge sprays of liquid adhesive. A drawback of such conventional procedures is that the application of adhesive cannot be carried out with a very high degree of accuracy, especially if the web is advanced at a high speed.

OBJECTS AND SUMMARY OF THE INVENTION

An object of the invention is to provide a novel and improved method of accurately applying liquid adhesive to a running web of wrapping material which is used in the tobacco processing industry.

Another object of the invention is to provide a method which renders it possible to apply the adhesive in a predictable manner regardless of the speed at which the web is advanced through a cigarette making, filter rod making or filter tipping machine.

A further object of the invention is to provide a method which renders it possible to apply to the running web any desired pattern, i.e., to prevent the application of adhesive to selected portions or sections of the running web.

An additional object of the invention is to provide a novel and improved apparatus for the practice of the above outlined method.

A further object of the invention is to provide the apparatus with novel and improved means for regulating the application of adhesive in such a way that the adhesive can be applied with a high degree of accuracy irrespective of eventual variations or fluctuations of one or more parameters of the running web, particularly the speed and/or the permeability of the web.

An additional object of the invention is to provide the apparatus with novel and improved means for converting a body of liquid adhesive into droplets and for applying the droplets to the running web of wrapping material.

A further object of the invention is to provide a web which is coated with adhesive in accordance with the above outlined method and/or in the apparatus of the present invention.

One feature of the invention resides in the provision of a method of applying adhesive to a running web of wrapping material which is used in the tobacco processing industry to make rods which contain fillers of smokable material and/or filter material for tobacco smoke. The method comprises the first step of forming droplets of liquid adhesive, a second step of electrically charging the droplets, and a third step of directing the electrically charged droplets toward the web by at least one electrically charged electrode. The method can further comprise the step of advancing the web along a predetermined path at any one of a plurality of different speeds, and the third step then includes directing the droplets at a variable rate so that the quantity of adhesive per unit area of the web is at least substantially constant regardless of the selected speed of the web.

The wrapping material can constitute a strip of tipping paper which is used to connect rod-shaped plain cigarettes with filter mouthpieces of unit length or multiple unit length.

As a rule, the web is permeable to air and the third step preferably includes directing droplets of adhesive toward first portions of the running web and leaving second portions of the web free of adhesive. Such method further comprises the steps of converting the web into the wrapper of a rod (such as a rod which contains a filter mouthpiece and at least one plain cigarette), monitoring the rod including generating signals which denote the permeability of the wrapper, and altering or adjusting the ratio of the areas of the first and second portions as a function of changes of characteristics of the generated signals. Such method can further comprise the step of subdividing the rod into sections of preselected length (e.g., into filter cigarettes of unit length). The monitoring step of this method then includes generating signals which denote the permeabilities of the wrappers of such sections. The just described method can further comprise the step of comparing the signals with a reference signal which denotes a predetermined permeability, and the altering step then includes reducing the ratio of second portions to first portions if the predetermined permeability is exceeded and increasing the ratio of second portions to first portions when the monitored permeability is below the predetermined permeability.

The wrapping material can constitute a strip of cigarette paper or filter paper.

Another feature of the invention resides in the provision of an apparatus for applying adhesive to a running web of wrapping material which is used in the tobacco processing industry to make rods containing fillers of smokable material and/or filter material for tobacco smoke. The apparatus comprises a source of liquid adhesive, means for converting the adhesive into a stream of droplets, means for electrically charging the droplets, and electrode means which is operable to direct the charged droplets of adhesive against the running web. The converting means can comprise at least one nozzle which is connected to the source of liquid adhesive and has at least one adhesive-discharging orifice. The charging means can include at least one electrode.

The apparatus can further comprise means for advancing the web at any one of a plurality of different speeds. Such apparatus further comprises means for regulating the operation of the electrode means as a function of selected speed of the web so that the quantity of adhesive which is applied per unit area of the web remains at least substantially constant.

If the adhesive is to be applied to a web of tipping paper, the apparatus can further comprise means for draping the adhesive-coated web around groups of coaxial plain cigarettes and filter mouthpieces.

If the web is permeable to air, the apparatus preferably further comprises means for operating the electrode means so as to apply droplets to first portions of the running web and to leave second portions of the web free of adhesive, means for draping the adhesive-carrying web around a rod-like filler so that the web constitutes the wrapper of the resulting rod, monitoring means having means for generating signals which denote the permeability of the wrapper, and means for adjusting the operating means as a function of changes of characteristics of the signals. The adjusting means of such apparatus can comprise a source of reference signals, and means for comparing the reference signals with the signals which are generated by the monitoring means and for influencing the adjusting means when the characteristics of reference signals deviate from characteristics of signals which are generated by the monitoring means.

The web which is to be coated with adhesive can be provided with perforations. The monitoring means of the apparatus for applying adhesive to such web can include means for generating signals which denote the permeability of successive wrapper lengths each of which has at least one perforation.

The adjusting means can include means for increasing the ratio of second portions to first portions when the signals denote a drop of permeability of the wrapper and for reducing the ratio of second portions to first portions and the signals denote an increase of permeability of the wrapper.

The improved apparatus can also be used to apply adhesive to a web of cigarette paper or filter paper. The apparatus which is used for such purposes can further comprise or can form part of a machine which drapes the adhesive-coated web around a continuous filler of smokable material or filter material for tobacco smoke.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 4 is a schematic partly elevational and partly sectional view of a device for monitoring the permeability of wrappers of filter cigarettes which are produced in the machine of FIG. 1; and FIG. 5 is a fragmentary plan view of a portion of a web of cigarette paper or filter paper which is coated with adhesive in the apparatus of the present invention.

DESCRIPTION OF THE PREFERRED EMBODIMENTS

Figure 1:
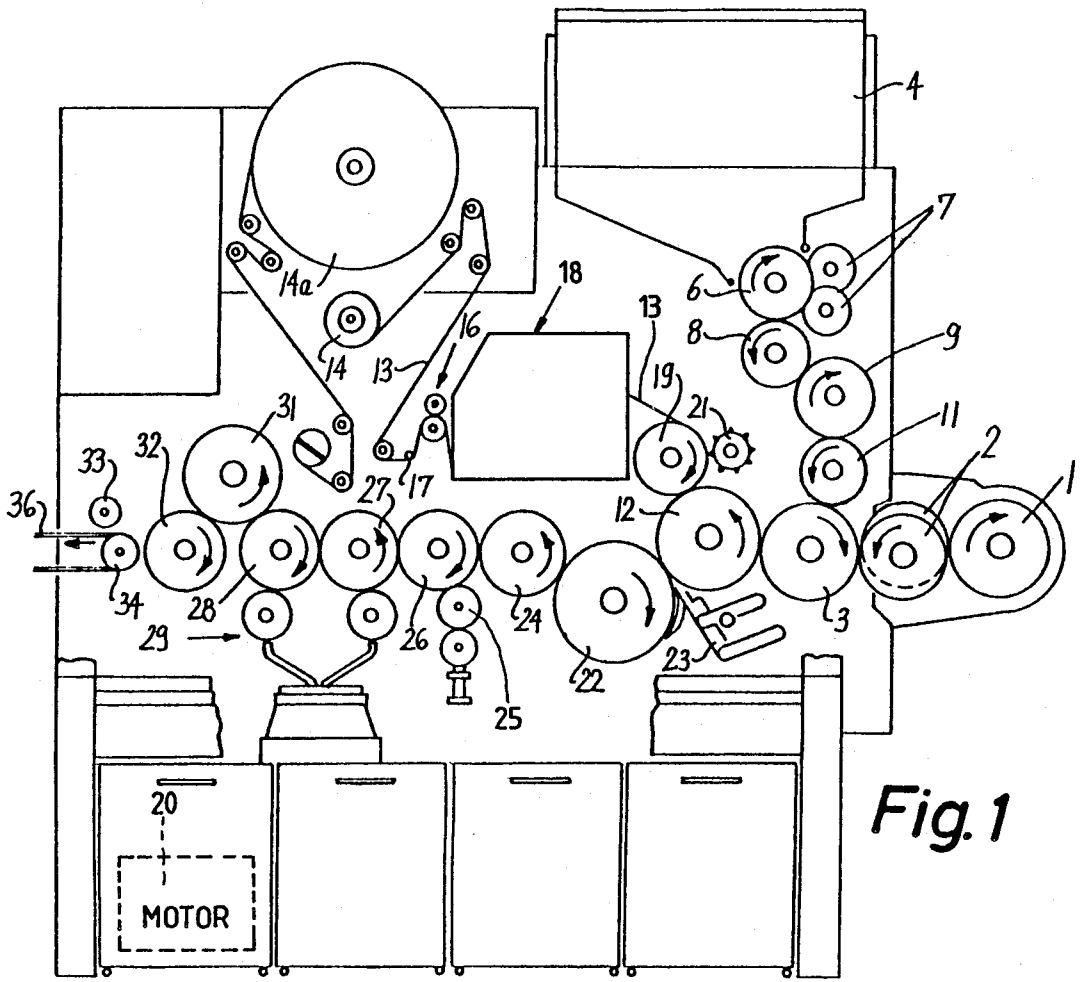
FIG. 1 is a schematic elevational view of a filter tipping machine which embodies one form of the improved apparatus.

FIG. 1 shows a filter tipping machine of the type known as MAX S which is produced by the assignee of the present application. This machine is coupled with a cigarette rod making machine, for example, with a machine known as GARANT which is manufactured by the assignee of the present application. The cigarette rod making machine discharges two rows of plain cigarettes of unit length in such a way that the cigarettes of one row are staggered with reference to the cigarettes in the other row. The two rows of cigarettes advance sideways, i.e., at right angles to the longitudinal axes of the cigarettes, and are transferred onto a first drum-shaped conveyor 1 which is shown in the right-hand portion of FIG. 1. The conveyor 1 delivers the two rows of plain cigarettes to two discrete aligning conveyors 2 which transport the cigarettes of the respective rows through different distances and/or at different speeds so as to ensure that each of a series of axially parallel peripheral flutes on a drum-shaped assembly conveyor 3 receives a pair of coaxial plain cigarettes of unit length which are spaced apart from each other by a distance at least matching the length of a filter mouthpiece of double unit length.

The frame of the filter tipping machine supports a magazine 4 which contains a supply of filter mouthpieces (filter rod sections) of six times unit length. The outlet of the magazine 4 admits filter mouthpieces into the peripheral flutes of a severing conveyor 6 which cooperates with two disc-shaped rotary knives 7 to subdivide each filter mouthpiece of six times unit length into three filter mouthpieces of double unit length. The conveyor 6 delivers the thus obtained three rows of filter mouthpieces of double unit length to three discrete staggering conveyors 8 (only one shown in FIG. 1) which transport the filter mouthpieces of the respective rows at different speeds and/or through different distances so that the filter mouthpieces of each row are staggered relative to the filter mouthpieces in the other two rows. The three rows of staggered filter mouthpieces of double unit length are shuffled on a conventional shuffling conveyor 9 which can cooperate with one or more stationary cams (not specifically shown) so as to shift one or two rows of filter mouthpieces axially and to form a single row of filter mouthpieces wherein each mouthpiece is in exact register with the preceding as well as with the next-following filter mouthpiece. Successive filter mouthpieces of the thus obtained single row are transferred into successive flutes of the assembly conveyor 3 by an accelerating conveyor 11 which deposits the filter mouthpieces into the gaps between the spaced-apart plain cigarettes in the respective flutes. The thus obtained groups of coaxial articles, each of which includes a pair of plain cigarettes and a filter mouthpiece therebetween, are accepted by successive flutes of a transfer conveyor 12. It is preferred to advance each group which is formed in a flute of the assembly conveyor 3 between two condensing cams (not specifically shown) so as to ensure that the inner ends of plain cigarettes of unit length abut the adjacent end faces of the respective filter mouthpiece of double unit length.

The frame of the filter tipping machine further supports a spindle for an expiring bobbin or reel 14 of wrapping material which constitutes tipping paper. The web 13 of tipping paper which is paid out by the reel 14 is caused to travel over the sharp cutting edge of a conventional curling device 17 which contributes to an equalization of internal stresses in the web 13, and successive increments of the web 13 thereupon advance through the nip of two advancing rolls 16 at least one of which is driven to draw the web off the reel 14. A second (fresh) reel **14*a* of tipping paper is held in a position of readiness so that the leading end of its web can be spliced to the trailing end of the expiring web 13** when the supply of tipping paper on the reel 14 is nearly exhausted. The exact construction of the splicing mechanism forms no part of the present invention. Reference may be had to numerous U.S. patents of the assignee of the present application.

The apparatus 18 which is located downstream of the advancing rolls 16 applies adhesive to selected portions of the running web 13, and the web thereupon advances onto a suction drum 19 which attracts the uncoated side of the web while the web is severed by the knives of a rotary drum-shaped cutter 21 so that the leader of the web 13 is subdivided into a series of discrete uniting bands. Such uniting bands are attached to successive groups of rod-shaped articles on the transfer conveyor 12 before the groups are transferred onto a rolling or wrapping conveyor 22 cooperating with a rolling device 23 which causes successive groups to rotate about their respective axes and to thereby convert the respective uniting bands into tubular bodies which connect the filter mouthpieces of double unit length to the adjacent end portions of the respective plain cigarettes of unit length.

The thus obtained filter cigarettes of double unit length are transferred onto a drum-shaped drying conveyor 24 and thence onto a severing conveyor 26 which cooperates with a rotary disc-shaped knife 25 to subdivide each filter cigarette of double unit length into two discrete filter cigarettes of unit length. The knife 25 severs successive filter mouthpieces midway between their end faces so that such filter mouthpieces are converted into mouth-pieces of unit length each of which is bonded to the adjacent plain cigarette of unit length by one-half of the respective uniting band. The arrangement is preferably such that defective filter cigarettes of double unit length (for example, those lacking a filter mouthpiece) are permitted or caused to drop off the severing conveyor 26 into a suitable collecting receptacle not shown.

The two rows of filter cigarettes of unit length are transferred into the flutes of a rotary drum-shaped conveyor 27 which cooperates with a turn-around device 29 of conventional design serving to invert the filter cigarettes of one row end-for-end and to deposit the inverted filter cigarettes into alternate flutes at the periphery of a rotary drum-shaped conveyor 28 which receives the non-inverted filter cigarettes from the conveyor 27 in such a way that the inverted and non-inverted filter cigarettes form a single row wherein all of the filter mouthpieces face in the same direction.

The conveyor 28 delivers successive filter cigarettes of unit length onto a testing conveyor 31 on which the integrity or lack of integrity of the wrappers of successive filter cigarettes is determined by a testing unit which can be of the type shown in FIG. 4. Satisfactory and defective filter cigarettes of unit length are transferred from the conveyor 31 onto a further testing conveyor 32 which can test the density of tobacco-containing ends of the filter cigarettes and is associated with means for ejecting defective filter cigarettes before they reach a take-off belt conveyor 36. The conveyor 36 is trained over pulleys 34 (only one shown) and cooperates with a braking drum 33. The upper reach of the belt conveyor 36 can deliver satisfactory filter cigarettes of unit length to a packing machine or to storage. The means for ejecting cigarettes which have been found to be defective (by the testing unit which cooperates with the conveyor 31 and/or by the testing unit which cooperates with the conveyor 32) can include a nozzle which discharges a jet of compressed air when it is in register with the defective cigarette. Defective cigarettes are expelled into a collecting receptacle, not shown.

Figure 2:
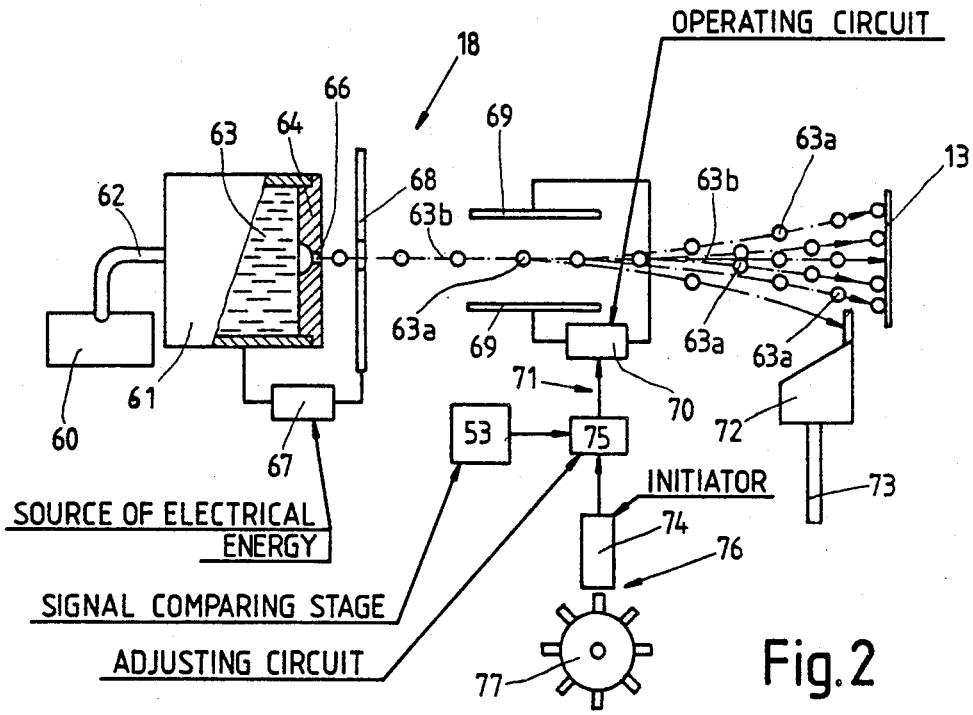
FIG. 2 is a partly diagrammatic and partly sectional view of the apparatus which can be utilized in the machine of FIG. 1.

The details of a presently preferred adhesive applying apparatus (paster) 18 are shown in FIG. 2. The apparatus 18 comprises a source 60 of liquid adhesive wherein the adhesive is maintained at an elevated pressure. A supply conduit 62 connects the source 60 with a plenum chamber 61 which can be said to constitute a nozzle. The front wall or plate 64 of the nozzle 61 has at least one orifice 66 which discharges a stream **63*b* of small droplets 63*a* of liquid adhesive. The wall or plate 64 is preferably a metallic conductor which is maintained at zero potential. The supply 63 of pressurized liquid adhesive is replenished by the supply conduit 62 at a rate at which the droplets 63*a* are discharged through the orifice 66 and thereupon through the opening of a charging electrode 68 which is connected to a source 67** of electrical energy.

The apparatus 18 further comprises two deflecting or diverting electrodes 69 which can be operated by a circuit 70 so as to direct the stream **63*b* against the running web 13 of tipping paper or into a collecting vessel 72 which is connected with a discharge conduit 73 serving to convey the collected liquid adhesive back to the source 60. The dimensions of the droplets 63*a* are greatly exaggerated in FIG. 2** for the sake of clarity.

The charging electrode 68 is preferably located immediately adjacent the orifice 66 in the plate or wall 64 of the nozzle 61. The arrangement is such that the droplets **63*a* which pass through the opening of the electrode 68 retain the charge which is imparted thereto by the electrode 68 at least until they reach the space between the deflecting electrodes 69**.

The means for adjusting the operating means 70 for the deflecting electrodes 69 comprises a programming unit 75 having an output 71 which is connected to the operating means 70 and determines the potential which is applied to the electrodes 69. The arrangement may be such that the operating means 70 causes the electrodes 69 to deflect the stream **63*b* alternatingly to both sides of a symmetry plane or line which passes through the orifice 66, through the opening of the charging electrode 68 and midway through the space between the deflecting electrodes 69. When the application of potential to the electrodes 69 is interrupted or when the potential is reduced below a threshold value, the stream 63*b* is caused or permitted to impinge upon the baffle of the collecting vessel 72 ahd to accumulate in the interior of the vessel to be returned into the source 60 by way of the conduit 73**.

Figure 3:
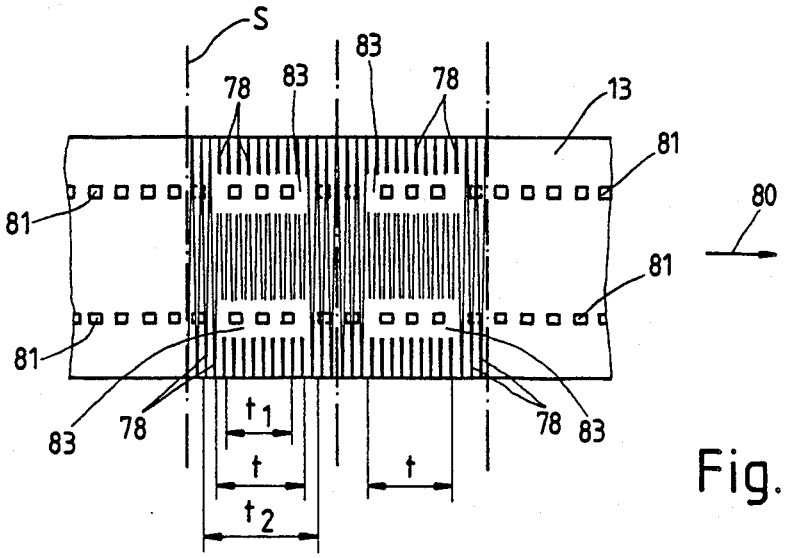
FIG. 3 is a plan view of a portion of a web of tipping paper which has been coated with adhesive in the apparatus of FIG. 2.

The programming unit 75 is preferably designed to ensure that the deflecting electrodes 69 cause the droplets **63*a* to form on the running web 13 a predetermined pattern, such as the pattern which is shown in FIG. 3. This pattern includes portions which are coated with rows or lines 78 of adhesive and portions 83 which are fre of adhesive. The reference characters 81 denote perforations which form two rows and are provided in the web 13 ahead of the apparatus 18, for example, in the plant which makes the reels 14 and 14*a*. The web 13 advances in the direction of the arrow 80, i.e. toward the suction drum 19 of FIG. 1. The distribution of droplets 83*a* on the running web 13 in the form of rows or lines 78** is the presently preferred mode of applying liquid adhesive to the running web.

The character S denotes one of the lines along which the web 13 is severed on the drum 19 to yield a succession of discrete uniting band which are attached to successive groups on the transfer conveyor 12.

The filter tipping machine comprises a prime mover 20 (e.g., a variable-speed electric motor) which drives all or nearly all rotary parts of the machine at any one of a plurality of different speeds (for example, at two different speeds, one for the starting and the other for normal operation of the machine). In order to ensure that the distribution of adhesive droplets 83*a* on the web 13 will not depend upon variations of speed of the motor 20 and hence on variations of the speed of the web 13, the apparatus preferably further comprises means for ensuring that the adjusting means 75 for the operating means 70 can influence the electrodes 69 in such a way that the quantity of adhesive which is applied per unit area of the running web 13 remains the same or nearly the same regardless of the selected speed of the motor 20 and web 13. To this end, the apparatus comprises a timing pulse generator 76 which is shown in FIG. 2 and includes a rotary disc 77 which is provided with an annulus of magnets or other actuating elements traveling past a stationary proximity detector or initiator 74 which is connected to one input of the adjusting means 75 so as to influence the operating means 70 as a function of the selected speed of the motor 20. The arrangement is such that the operating means 70 causes the deflecting electrodes 69 to reduce the number of lines which are formed on the web 13 per unit of time when the speed of forward movement of the web 13 is increased and vice versa. For example, if the speed of the motor 20 and web 13 is reduced by 10%, the apparatus 18 can be operated in such a way that the number of lines 78 per unit of time is reduced from 10 to 9. If the speed is reduced by 20%, the apparatus 18 is caused to reduce the number of lines 78 per unit of time from 5 to 4, and the apparatus will reduce the number of lines 78 from 2 to 1 per unit of time if the speed of the motor 20 and web 13 is reduced in half. Alternatively, the apparatus 18 can be caused to skip each tenth, fifth or second line 78. Minor departures of distribution of droplets in the lines 78 from optimum distribution are of no consequence because the droplets are smeared over the adjacent portions of the web 13 when the latter is draped around the respective group of rod-shaped articles on the wrapping conveyor 22 of FIG. 1.

Referring again to FIG. 3, the perforations 81 in the web 13 serve to ensure that a certain amount of atmospheric air will flow into the column of tobacco smoke when the respective filter cigarette is lighted. In other words, the web 13 is permeable to air, either exclusively as a result of the provision of perforations 81 or as a result of the provision of such perforations plus the inherent permeability of the material of the web. In order to ensure that the permeability of the wrapper of a finished filter cigarette of unit length will match a desired value, at least the majority of perforations 81 in the web 13 should not be clogged by adhesive. Therefore, the operating means 70 is preferably controlled by an adjusting means 75 which can constitute a programming unit capable of regulating the application of lines 78 of droplets 63*a* in a manner as shown in FIG. 3, namely so that the uncoated portions 83 of the web 13 surround the perforations 81 of the respective rows. Programming units which can control the charges of deflecting electrodes 69 in a manner as shown in FIG. 3 are available on the market and need not be described in detail here. It has been found that the electrodes 69 can ensure a desirable distribution of adhesive-coated and uncoated portions of the web 13 even when the web is driven at a very high speed such as is required in a modern filter tipping machine which turns out many thousands of filter cigarettes per minute.

FIG. 3 shows two rows of perforations 81 because the web 13 has twice the unit width. It will be recalled that the web 13 of FIG. 3 is subdivided into uniting bands each of which is dimensioned to completely surround a filter mouthpiece of double unit length plus the adjacent end portions of the respective plain cigarettes. It is equally within the scope of the invention to provide the web 13 with four, six or more rows of perforations 81 so that the uniting band of each filter cigarette of unit length will carry two, three or more annuli of perforations 81. This depends on the desired quantity of atmospheric air which is to flow into the filter cigarette when the cigarette is lighted. The filter cigarette Z which is shown in FIG. 4 on the testing conveyor 31 has a single row of perforations 81 which form a ring P. Such ring is disposed in that portion of the respective uniting band which is immediately adjacent the plane wherein the filter mouthpiece F abuts the respective end of the plain cigarette.

In order to ensure that the permeability of finished products (filter cigarettes Z) will match or closely approximate an optimum value, the operating means 70 for the deflecting electrodes 69 of the apparatus 18 is or can be influecced by signals which are generated by means for monitoring the permeability of successive filter cigarettes Z. One form of monitoring means which can be utilized in the apparatus of the present invention is shown in FIG. 4. The testing conveyor 31 of FIG. 4 has a plurality of axially parallel peripheral flutes 37 each of which is provided with two axially spacedapart webs or ribs 38 having suction ports 39 connected to a suction generating device which ensures that the filter cigarette which has been supplied by the conveyor 28 remains in the respective flute 37 until it reaches the transfer station between the testing conveyors 31 and 32. The manner of regulating suction in the suction ports of a testing conveyor for cigarettes or the like is disclosed in numerous U.S. patents of the assignee of the present application. As a rule, the means for ensuring that the suction ports 39 are connected with the suction generating device during the required interval of time can comprise a stationary valve plate which is adjacent to one axial end of the conveyor 31.

The cigarettes Z are tested with streams of air or another gaseous fluid which is admitted into the slots 41*a*, 41*b* of two stationary valving elements 42*a*, 42*b* at the respective axial ends of the conveyor 31. The conveyor 31 has two flanges which are adjacent the respective valving elements and are provided with bores, one for each of the flutes 37. A cigarette Z which is properly received in its flute 37 is held by a reciprocable plug-shaped sealing element 43 which is biased by a coil spring 46 so that the cigarette is prevented from leaving its flute in the course of the testing operation. The sealing element 43 has an axial bore which is in register with the slot 41*b* of the respective valving element 42*b* during travel of the cigarette Z past the testing station. The sealing elements 43 can be retracted by a stationary cam in a manner which is not specifically shown in FIG. 4 so as to allow for transfer of a freshly tested cigarette Z from the conveyor 31 onto the conveyor 32 as well as for admission of a fresh cigarette Z from the conveyor 28 onto the conveyor 31. The cam operates against the bias of the respective coil springs 46 to temporarily retract the shanks of the sealing elements 43 into the respective flange of the rotating conveyor 31.

The testing apparatus further comprises a source 47 of pressurized testing fluid which is connected with the slots 41*a* and 41*b* by conduits 44*a* and 44*b*. The connection between the conduits 44*a* and 44*b* on the one hand and the outlet of the source 47 on the other hand contains a valve 48 and a flow restrictor 49. A further flow restrictor 50 is provided in the conduit 44*b* so as to enhance the sensitivity of the testing apparatus in the region of the ring P consisting of one or more annuli of perforations 81.

The reference character 51 denotes a transducer which generates signals denoting the permeability of the wrappers of successive filter cigarettes Z. The output of the transducer 51 is connected with the input of an integrator 52 which generates a signal denoting the average permeability of a preselected number of successively tested filter cigarettes Z. The output of the integrator 52 is connected to the corresponding input of a signal comparing stage 53 forming part of the means for adjusting the operating means 70 for the deflecting electrodes 69. Another input of the signal comparing stage 53 is connected with a potentiometer 54 which constitutes a source of reference signals denoting the desired permeability of the wrappers of filter cigarettes Z. The output of the signal comparing stage 53 is connected with the corresponding input of the adjusting means 75. This can be seen in FIG. 2. The transducer 51 can constitute a pneumatic-electrical transducer operating with a suitable membrane and a capacitor which monitors the position of the membrane. The position of the membrane is a function of the pressure in the conduit 44*b* and hence of permeability of the wrapper of the tested filter cigarette Z. A suitable transducer is disclosed in commonly owned U.S. Pat. No. 3,412,856 to Esenwein. The signals which are generated by the transducer 51 are indicative primarily of the permeability of that portion of a filter cigarette Z which is formed with perforations 81.

Testing apparatus which can be used to determine the permeability of successive filter cigarettes are disclosed, for example, in commonly owned U.S. Pat. No. 4,177,670 to Heitmann and in commonly owned U.S. Pat. No. 4,282,889 to Dahlgrün.

The output signal of the signal comparing stage 53 can influence the operating means 70 in a manner as shown in FIG. 3. The character t denotes the average length of an uncoated or adhesive-free portion 83 of the web 13. Such length can be increased to $t_2$ or reduced to $t_1$ depending on the ascertained permeability of a series of successive filter cigarettes Z. If the permeability is too low, the length of the uncoated portions 83 is increased from t to $t_2$. On the other hand, if the permeability is too high, the length of uncoated portions 83 is reduced from t to $t_1$. The electrodes 69 divert the stream 63*a* into the vessel 72 when the portions 83 advance past the adhesive applying station. It is not necessary that the stream 63*b* be deflected into the vessel 72 whenever an adhesive-free portion 83 is to be formed. The electrode 69 can also cause the stream 63*b* to simply skip the portions 83 on the running web 13.

The apparatus 18 of FIG. 2 can be modified in a number of ways without departing from the spirit of the invention. For example, the plate 64 of the nozzle 61 can have several orifices. Furthermore, the apparatus 18 can comprise a battery of two or three discrete nozzles 61 which are disposed in a row or in another suitable distribution.

FIG. 5 shows a portion of a web 113 which can be made of cigarette paper or filter paper. The direction in which the web advances is indicated by the arrow 180. One marginal zone 186 of the running web 113 is coated with adhesive droplets 178 but the major portion 187 of the web 113 remains uncoated. This is the customary way of applying adhesive to a web of cigarette paper or filter paper. The marginal zone 186 is caused to overlie the other marginal portion when the web 113 is draped around a rod-like filler of tobacco, other smokable material or filter material so that the draped web 113 then constitutes a tubular wrapper. The two marginal portions constitute the customary seam which extends longitudinally of a cigarette or a filter rod section. Liquid adhesive which is applied to a web of cigarette paper or filter paper may but need not be the same as the adhesive which is applied to tipping paper. The apparatus which is used to apply droplets of adhesive to a web of cigarette paper or filter paper can be much simpler than the apparatus of FIG. 2 because the operating means 70 need not be influenced by a variety of parameters except, if necessary, by the selected speed of the web 113.

An important advantage of the improved method and apparatus is that the application of adhesive to the running web can be carried out in a predictable manner regardless of the selected speed of the web. Furthermore, the method and apparatus can be utilized with advantage in order to preserve the permeability of perforations which are formed in the web prior to application of the adhesive. Predictable permeability of the wrappers of smokers' articles is important to the manufacturers of such articles as well as to the consumers. The means for monitoring the permeability of the wrapper (either of a continuous wrapper or of discrete wrappers forming component parts of successively formed rod-shaped articles, such as filter cigarettes) can be of conventional design.

The adjusting means for the means which regulates the operation of the deflecting electrodes 69 is of simple design and is capable of regulating the application of adhesive droplets with a very high degree of accuracy. This holds true not only when the application of adhesive must take place along a selected marginal portion of a web (113) but also when the application of adhesive has to take place across the full width of a rather wide web (13) which can be used as a starting material for uniting bands which are to be draped around the filter mouthpieces of double unit length.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of applying adhesive to a running web of wrapping material which is used in the tobacco processing industry for the making of rods containing fillers of smokable material and/or filter material for tobacco smoke, comprising a first step of forming droplets of liquid adhesive; a second step of electrically charging the droplets; and a third step of directing the droplets toward the web by at least one electrically charged electrode.

2. The method of claim 1, further comprising the step of advancing the web along a predetermined path at any one of a plurality of different speeds, said third step including directing the droplets at a variable rate so that the quantity of adhesive per unit area of the web is at least substantially constant regardless of the selected speed of the web.

3. The method of claim 1, wherein the wrapping material is tipping paper which is used to connect rod-shaped plain cigarettes with filter mouthpieces.

4. The method of claim 1, wherein the web is permeable to air and said third step includes directing droplets of adhesive toward first portions of the running web and leaving second portions of the web free of adhesive, and further comprising the steps of converting the web into the wrapper of a rod, monitoring the rod including generating signals denoting the permeability of the wrapper, and altering the ratio of the areas of said first and second portions as a function of changes of the characteristics of said signals.

5. The method of claim 4, further comprising the step of subdividing the rod into sections of preselected lengths, said monitoring step including generating signals which denote the permeabilities of the wrappers of said sections.

6. The method of claim 4, further comprising the step of comparing said signals with a reference signal denoting a predetermined permeability, said altering step including reducing the ratio of second portions to first portions when the predetermined permeability is exceeded and increasing the ratio of second portions to first portions when the monitored permeability is below the predetermined permeability.

7. The method of claim 1, wherein the wrapping material is cigarette paper.

8. The method of claim 1, wherein the wrapping material is filter paper.

9. Apparatus for applying adhesive to a running web of wrapping material which is used in the tobacco processing industry for the making of rods containing fillers of smokable material and/or filter material for tobacco smoke, comprising a source of liquid adhesive; means for converting the adhesive into a stream of droplets; means for electrically charging the droplets; and electrode means operable to direct charged droplets against the web.

10. The apparatus of claim 9, wherein said converting means comprises at least one nozzle connected to said source and having at least one adhesive-discharging orifice.

11. The apparatus of claim 9, wherein said charging means includes at least one electrode.

12. The apparatus of claim 9, further comprising means for advancing the web at any one of a plurality of different speeds, and means for regulating the operation of said electrode means as a function of the selected speed of the web so that the quantity of adhesive which is applied per unit area of the web remains at least substantially constant.

13. The apparatus of claim 9 for applying adhesive to a web of tipping paper, further comprising means for draping the adhesive-coated web around groups of coaxial plain cigarettes and filter mouthpieces.

14. The apparatus of claim 9 for applying adhesive to a web which is permeable to air, further comprising means for operating said electrode means so as to apply droplets to first portions of the running web and to leave second portions of the web free of adhesive, means for draping the adhesive-carrying web around a rod-like filler so that the web constitutes the wrapper of the resulting rod, monitoring means having means for generating signals denoting the permeability of the wrapper, and means for adjusting said operating means as a function of changes of the characteristics of said signals.

15. The apparatus of claim 14, wherein said adjusting means comprises a source of reference signals and means for comparing the reference signals with the signals which are generated by said monitoring means and for influencing said adjusting means when the characteristics of said reference signals deviate from the characteristics of signals which are generated by said monitoring means.

16. The apparatus of claim 14 for applying adhesive to a web which has perforations therein, wherein said monitoring means includes means for generating signals denoting the permeability of successive wrapper lengths each of which has at least one perforation.

17. The apparatus of claim 14, wherein said adjusting means includes means for increasing the ratio of second portions to first portions when the signals denote a drop of permeability of the wrapper and for reducing the ratio of second portions to first portions when the signals denote an increase of permeability of the wrapper.

18. The apparatus of claim 9 for applying adhesive to a web of cigarette paper or filter paper, further comprising means for draping the adhesive-coated web around a continuous filler of smokable material or filter material for tobacco smoke.

* * * * *